US008424252B2

(12) United States Patent
Tsai et al.

(10) Patent No.: US 8,424,252 B2
(45) Date of Patent: Apr. 23, 2013

(54) BUCKLING RESTRAINED BRACE

(75) Inventors: Keh-Chyuan Tsai, Taipei (TW); Chih-Yu Wei, Taoyuan County (TW)

(73) Assignee: National Applied Research Laboratories, Taipei (TW)

( * ) Notice: Subject to any disclaimer, the term of this patent is extended or adjusted under 35 U.S.C. 154(b) by 387 days.

(21) Appl. No.: 12/398,589

(22) Filed: Mar. 5, 2009

(65) Prior Publication Data

US 2010/0005737 A1 Jan. 14, 2010

(30) Foreign Application Priority Data

Jul. 9, 2008 (TW) ..... 97125878 A

(51) Int. Cl.
*E04B 1/98* (2006.01)
*E04H 9/02* (2006.01)

(52) U.S. Cl.
USPC ..... 52/167.3; 52/167.1; 52/223.4; 52/223.8

(58) Field of Classification Search ..... 52/167.3, 52/167.1, 240, 223.1, 223.4, 223.8, 223.14, 52/222, 638, 642, 693, 695, 655.1, 657, 653.1
See application file for complete search history.

(56) References Cited

U.S. PATENT DOCUMENTS 7,191,987 B2 * 3/2007 Heath ..... 248/62
7,231,743 B2 * 6/2007 Takeuchi et al. ..... 52/167.3
7,305,799 B2 * 12/2007 Smelser et al. ..... 52/167.3
7,373,758 B2 * 5/2008 Tsai et al. ..... 52/834

* cited by examiner

*Primary Examiner* — Joshua J Michener
*Assistant Examiner* — Chi Q Nguyen
(74) *Attorney, Agent, or Firm* — McNees Wallace & Nurick LLC

(57) ABSTRACT

A buckling restrained brace includes an axial member and a restraining unit. The axial member extends along an axial direction, and has two coupling sections for connecting respectively to two connecting plates of a framework of a building, and a middle section connected between the coupling sections. Each coupling section has a supplying plate portion coplanar with an elongated plate body of the middle section, and a contacting plate portion extending perpendicularly from the supporting plate portion. An outer end of the supplying plate portion of each coupling section has a groove formed therethrough along a transverse direction of the axial member, extending along the axial direction, and permitting a respective one of the connecting plates to engage fittingly therewith and contact the corresponding contacting plate portion.

30 Claims, 16 Drawing Sheets

BUCKLING RESTRAINED BRACE

CROSS-REFERENCE TO RELATED APPLICATION

This application claims priority of Taiwanese Application No. 097125878, filed on Jul. 9, 2008.

BACKGROUND OF THE INVENTION

1. Field of the Invention

This invention relates to a buckling restrained brace, and more particularly to a buckling restrained brace that is formed with grooves for engaging respectively connecting plates of a framework of a building.

2. Description of the Related Art

Buckling restrained braces are used in a steel framework of a building for absorbing vibration energy generated by an earthquake, to delay the damage of the framework resulting from the shock of the earthquake, and to break prior to breakage of the parts of the framework coupled to the buckling restrained braces. In general, current buckling restrained braces can be classified into the following three types:

1. Single-tube and single-core type. Referring to FIGS. 1 and 2, a single-tube and single-core type buckling restrained brace 6 includes an axial member 61 and a restraining unit 62. The axial member 61 has a middle section 611 of a cross-shaped cross-section, and two coupling sections 612 connected respectively to two ends of the axial member 61. The restraining unit 62 includes a steel tube 621 disposed around the axial member 61, and a concrete material 622 filling a space between the axial member 61 and the steel tube 621.

Referring to FIG. 3, each of the coupling sections 612 of the axial member 61 is connected fixedly to a connecting plate 7 of the framework by a coupling unit. The coupling unit includes a plurality of abutment plates 71 (only two are shown) and a plurality of bolts 72. Such connecting process is time-consuming.

2. Single-tube and Dual-core type. Referring to FIGS. 4 and 5, a single-tube and dual-core type buckling restrained brace 8 includes an axial member 81 and a restraining unit 82. The axial member 81 includes two elongated steel plates 811 parallel to each other. The restraining unit 82 includes a steel tube 821 and a concrete material 822 filling spaces among the steel tube 821 and the steel plates 811.

With further reference to FIG. 6, each end of the axial member 81 is connected fixedly to a connecting plate 7' by two bolts 72'. The steel plates 811 are spaced apart from each other by a distance (d) to define two grooves 812 at the ends of the axial member 81. Each of the connecting plates 7' is fixed within the corresponding groove 812 and between the steel plates 811 by the bolts 72'. The connecting plate 7' has a thickness (t).

This type of buckling restrained braces suffer from the following disadvantages:

(1) High manufacturing precision is required to allow the connecting plates 7' to engage respectively and fittingly the grooves 812. In case the thickness (t) is greater than the distance (d), the connecting plates 7' cannot be inserted into the steel plates 811. In case the thickness (t) is smaller than the distance (d), the connecting plates 7' cannot be fixed between the steel plates 811.

(2) Since the steel plates 811 are parallel to the connecting plates 7', when subjected to a force resulting from an earthquake in a direction perpendicular to the connecting plates 7', buckling of the steel plates 811 easily occurs.

3. Dual-tube and dual-core type. Referring to FIGS. 7 and 8, a dual-tube and dual-core type buckling restrained brace 9 includes a pair of first and second supporting units 91, 92, each of which is similar in construction to the single-tube and single-core type buckling restrained brace 6 (see FIG. 2). Each of the supporting units 91, 92 includes an axial member 911, 921, and a restraining unit 912, 922. Unlike the single-tube and single-core type buckling restrained brace 6 (see FIG. 2), the axial members 911, 921 have a T-shaped cross-section.

With further reference to FIG. 9, to interconnect the dual-tube and dual-core type buckling restrained brace 9 and a connecting plate 7", the connecting plate 7" is first sandwiched between an adjacent pair of parallel plate portions of the axial members 911, 921, and is subsequently locked between the same by a plurality of bolts 72". Thereafter, two steel plates 93 are welded to the restraining units 912, 922.

Since the axial members 911, 921 are T-shaped in cross-section, when subjected to a force resulting from an earthquake in a direction perpendicular to the connecting plate 7", buckling of the steel plates 811 can be reduced. Furthermore, the connecting plate 7" can be fixed effectively to the axial members 911, 921 due to the fact that the connecting plate 7" can be clamped between the adjacent pair of parallel plate portions of the axial members 911, 921 prior to welding of the steel plates 93 thereto. However, the dual-tube and dual-core type buckling restrained brace 9 has a drawback. That is, due to inclusion of two supporting units 91, 92 in the dual-tube and dual-core type buckling restrained brace 9, a substantial amount of the steel material is required to form the axial members 911, 921 and the tubes of the restraining units 912, 922.

SUMMARY OF THE INVENTION

The object of this invention is to provide a buckling restrained brace that can overcome the above-mentioned drawbacks associated with the prior art.

Accordingly, a buckling restrained brace of this invention includes an axial member and a restraining unit. The axial member extends along an axial direction, and has two coupling sections for connecting respectively to two connecting plates of a framework of a building, and a middle section connected between the coupling sections. Each of the coupling sections has a supplying plate portion coplanar with an elongated plate body of the middle section, and a contacting plate portion extending perpendicularly from the supporting plate portion. An outer end of the supplying plate portion of each of the coupling sections has a groove formed therethrough along a transverse direction of the axial member, extending along the axial direction, and permitting a respective one of the connecting plates to engage fittingly therewith and contact the corresponding contacting plate portion.

Due to the presence of the grooves, the buckling restrained brace can be connected easily to the connecting plates.

Furthermore, since the supporting plate portions are perpendicular to the connecting plates, when subjected to a force resulting from an earthquake in a direction perpendicular to the connecting plates, buckling of the axial member can be reduced.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
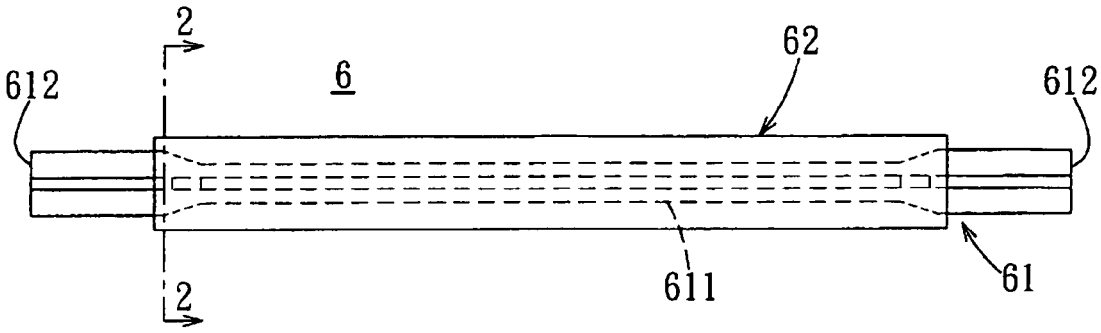
FIG. 1 PRIOR ART
FIG. 1 is a schematic side view of a single-tube and single-core type conventional buckling restrained brace.
Figure 2:
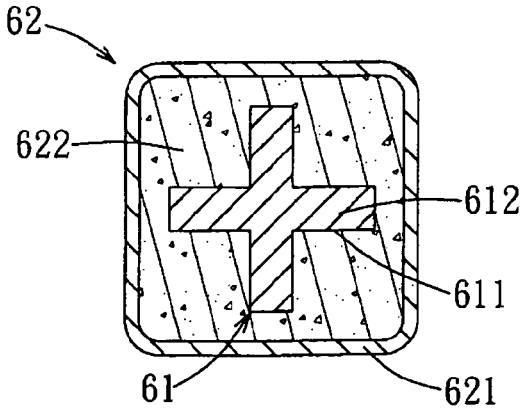
FIG. 2 PRIOR ART
FIG. 2 is a sectional view taken along line 2-2 in FIG. 1.
Figure 3:
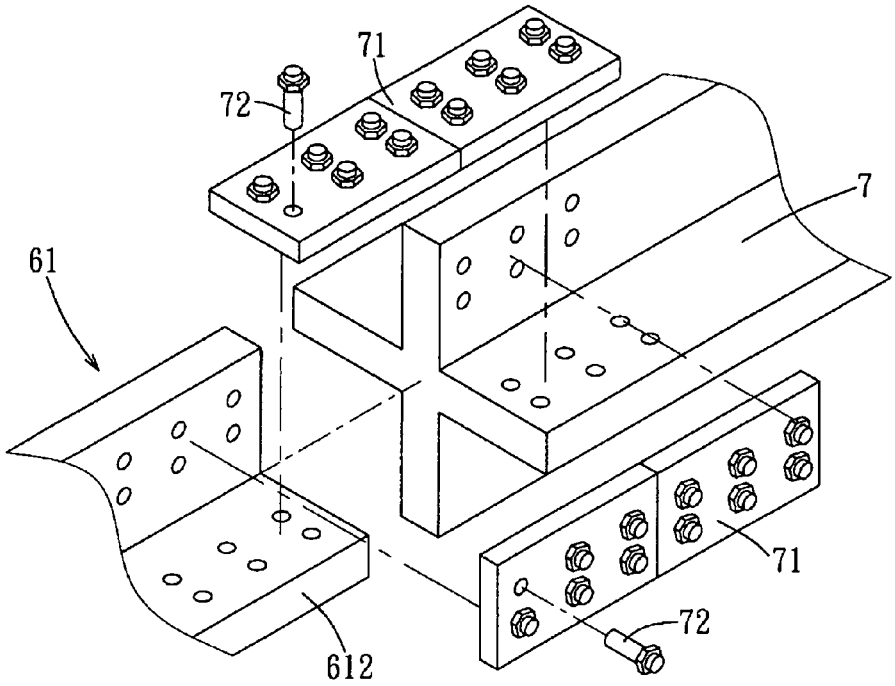
FIG. 3 PRIOR ART
FIG. 3 is a fragmentary exploded perspective view of an axial member of the single-tube and single-core type conventional buckling restrained brace, a connecting plate, and a coupling unit.

Before the present invention is described in greater detail in connection with the preferred embodiments, it should be noted that similar elements and structures are designated by like reference numerals throughout the entire disclosure.

Referring to FIGS. 10, 11, 12, and 13, the buckling restrained brace 100 is connected fixedly between two connecting plates 210 of a steel framework 200 of a building, and includes an axial member 1 and a restraining unit 2.

Figure 11:
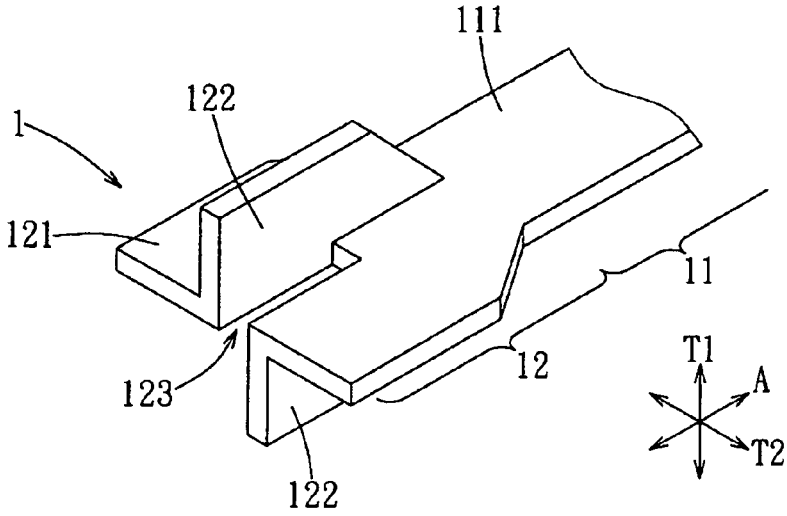
FIG. 11 is a fragmentary perspective view of an axial member of the first preferred embodiment, illustrating a coupling section of the axial member.
Figure 12:
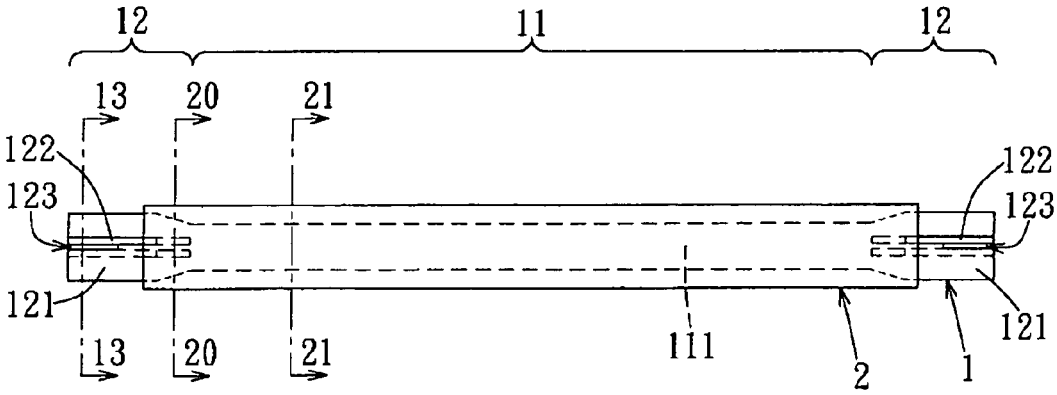
FIG. 12 is a schematic side view of the first preferred embodiment.
Figure 13:
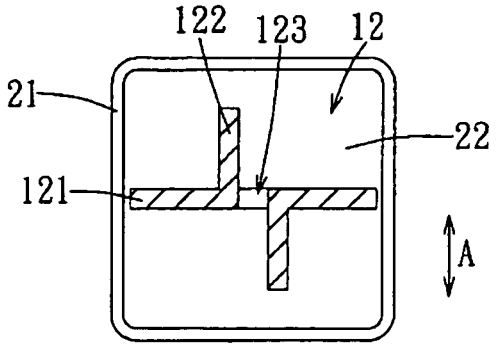
FIG. 13 is a sectional view taken along line 13-13 in FIG. 12.
Figure 14:
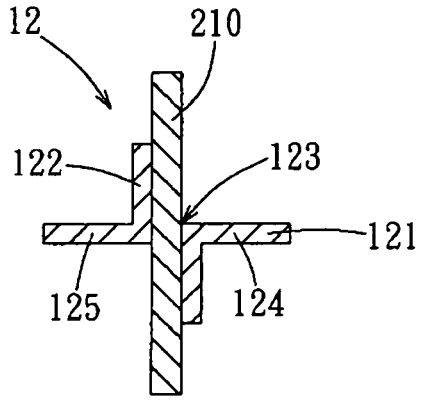
FIG. 14 is a sectional view taken along line 14-14 in FIG. 10.
Figure 19:
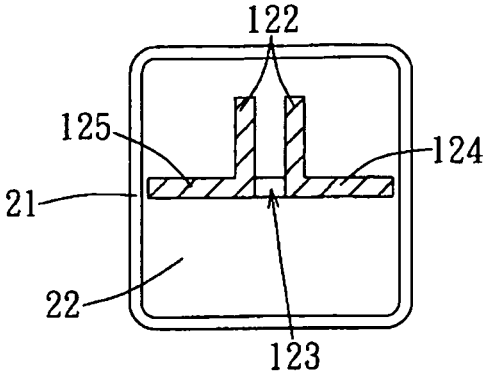

The axial member 1 extends along an axial direction (A), and has a middle section 11 and two coupling sections 12 extending respectively and integrally from two opposite ends of the middle section 11. The middle section 11 has an elongated plate body 111. Each coupling section 12 has a supporting plate portion 121 coplanar with the elongated plate body 111, and two contacting plate portions 122 extending respectively from two opposite side surfaces of the supporting plate portion 121 along a first transverse direction (T1) perpendicular to the axial direction (A), as shown in FIGS. 11 and 13. Alternatively, the contacting plate portions 122 may extend from one side surface of the supporting plate portion 121, as shown in FIG. 19. The supporting plate portion 121 of each coupling section 12 has a groove 123 that extends along the axial direction (A), that is formed therethrough along the first transverse direction (T1), and that permits the corresponding connecting plate 210 to engage fittingly therewith. The contacting plate portions 122 define two opposite sides of the corresponding groove 123, and are in contact with and parallel to the corresponding connecting plate 210, as shown in FIG. 14. As such, the distal end of each coupling section 12 has a cross-section that includes two L-shapes, as shown in FIG. 13.

The restraining unit 2 includes a surrounding member 21 disposed around the axial member 1, and a restraining member 22 disposed between the axial member 1 and the surrounding member 21 so as to provide a radial restraining force to the axial member 1.

Figure 4:
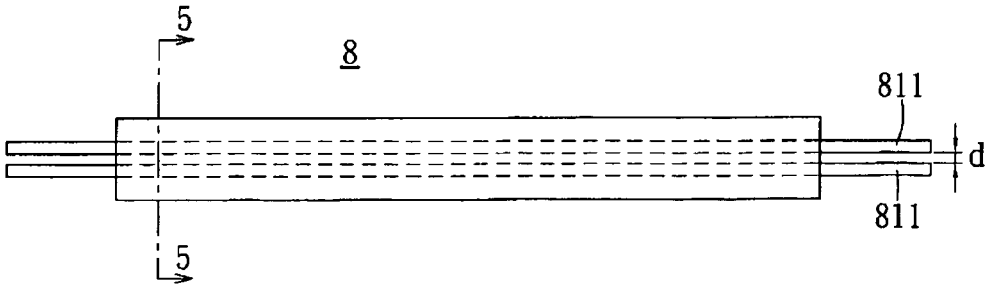
FIG. 4 PRIOR ART
FIG. 4 is a schematic side view of a single-tube and dual-core type conventional buckling restrained brace.
Figure 5:
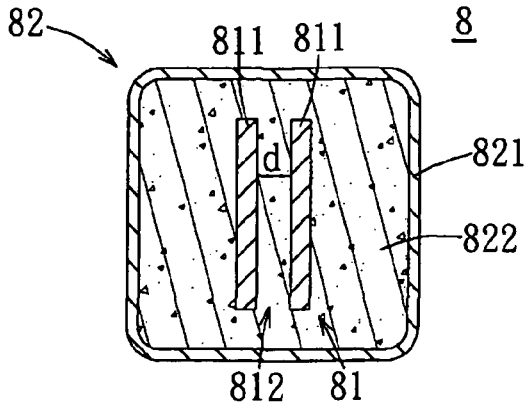
FIG. 5 PRIOR ART
FIG. 5 is a sectional view taken along line 5-5 in FIG. 4.
Figure 6:
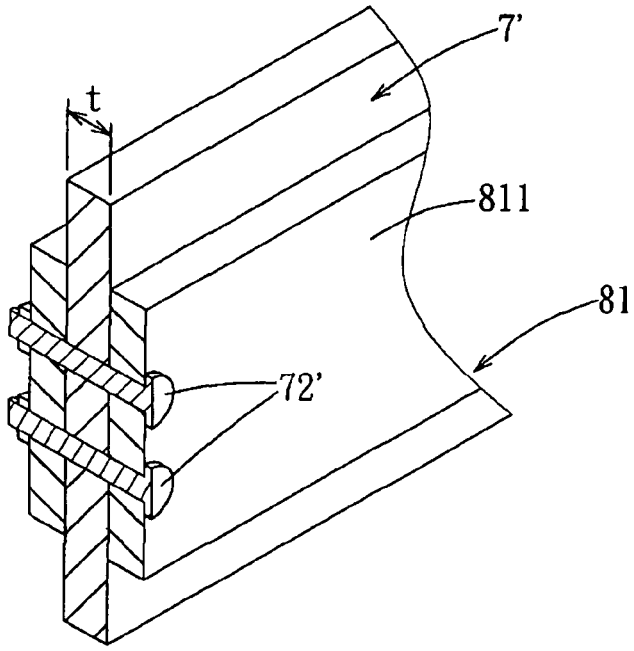
FIG. 6 PRIOR ART
FIG. 6 is a fragmentary assembled perspective view of an axial member of the single-tube and dual-core type conventional buckling restrained brace and a connecting plate.
Figure 7:
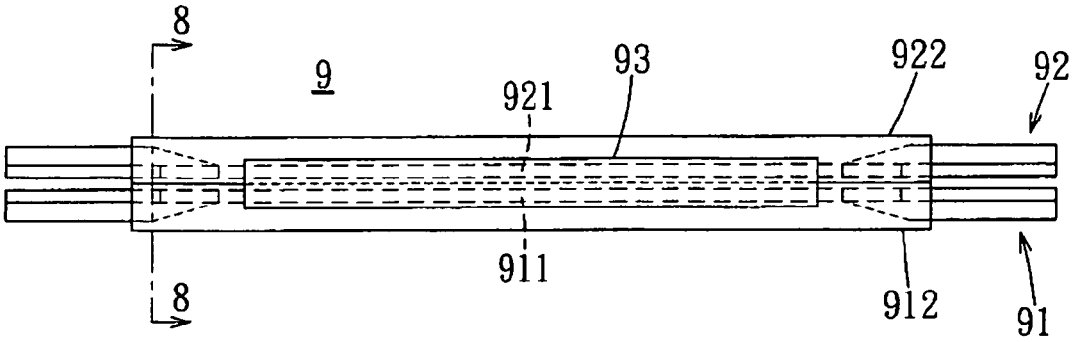
FIG. 7 PRIOR ART
FIG. 7 is a schematic side view of a dual-tube and dual-core type conventional buckling restrained brace.
Figure 8:
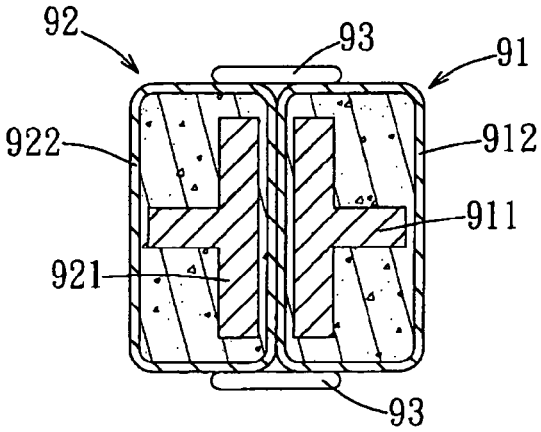
FIG. 8 PRIOR ART
FIG. 8 is a sectional view taken along line 8-8 in FIG. 7.
Figure 9:
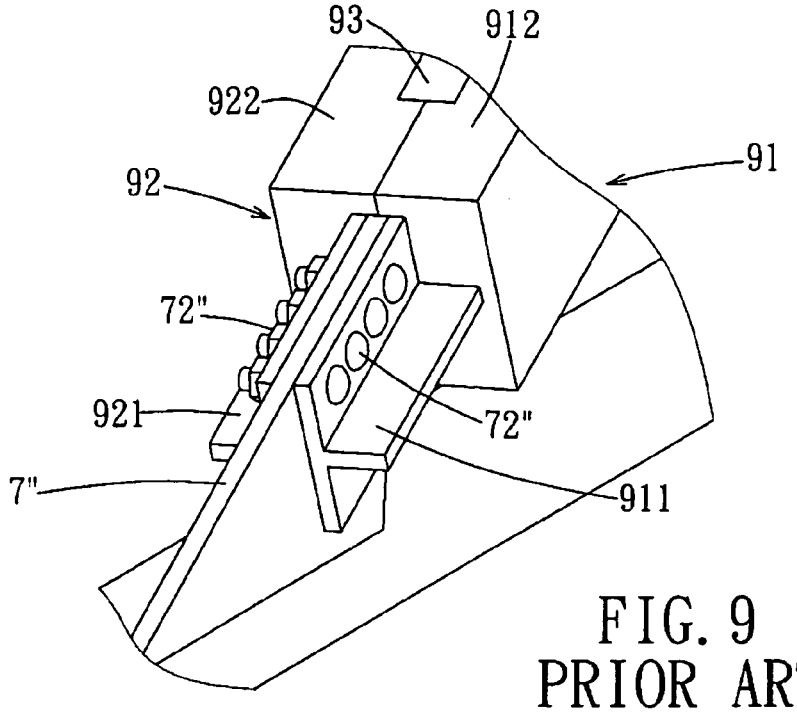
FIG. 9 PRIOR ART
FIG. 9 is a fragmentary assembled perspective view of the dual-tube and dual-core type conventional buckling restrained brace and a connecting plate.
Figure 10:
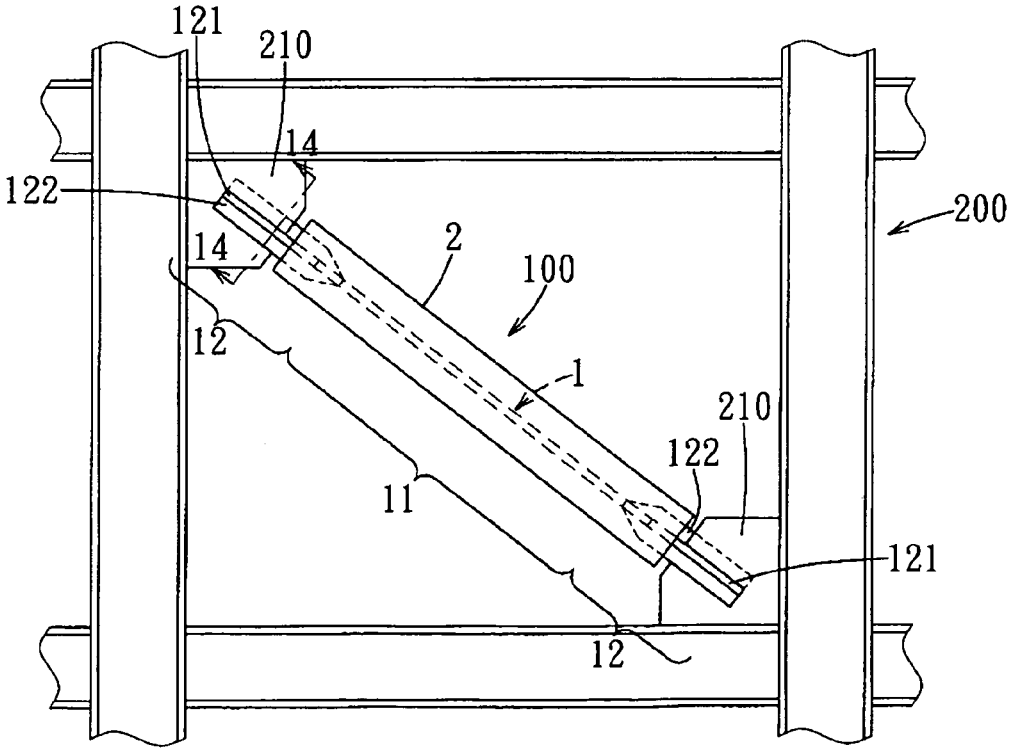
FIG. 10 is a schematic view of the first preferred embodiment of a buckling retrained brace according to this invention and a framework of a building.

To interconnect the buckling restrained brace 100 and one connecting plate 210, it is only necessary to insert the connecting plate 210 into the corresponding groove 123, and subsequently anchor the contacting plate portions 122 to the connecting plate 210 by soldering or bolts. With further reference to FIGS. 4 and 5, such connecting process is easier than that used for the single-tube and dual-core type conventional buckling restrained brace 8 due to the fact that the steel plates 811 must be spaced apart from each other by an accurate and precise distance (d).

Furthermore, since the supporting plate portions 121 are perpendicular to the connecting plates 210, when subjected to a force resulting from an earthquake in a direction perpendicular to the connecting plates 210, buckling of the axial member 1 can be prevented.

Figure 15:
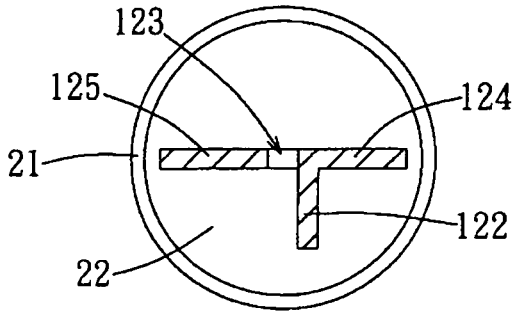
FIGS. 15 to 19 are views similar to FIG. 13 but illustrating modifications to the shapes of a rigid tube and a coupling section of the axial member of the first preferred embodiment.
Figure 16:
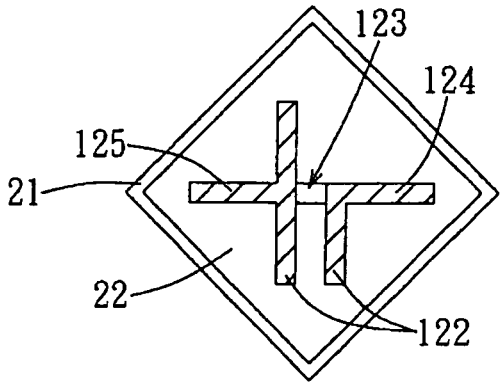
Figure 17:
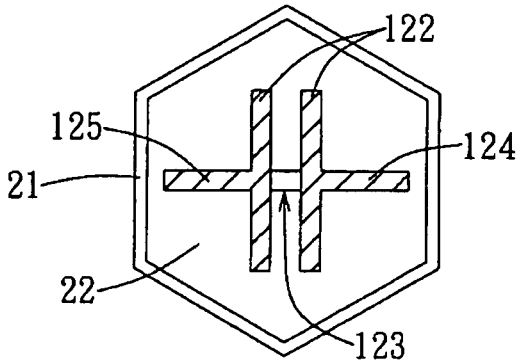

In this embodiment, the surrounding member 21 is configured as a rigid tube, which has two ends sleeved fixedly on the axial member 1 in a tight fitting manner and which can be made of steel or any other suitable high-strength metal. The shape of the rigid tube 21 may be a rectangle (see FIG. 13), a circle (see FIG. 15), a rhombus (see FIG. 16), or a hexagon (see FIG. 17).

Figure 18:
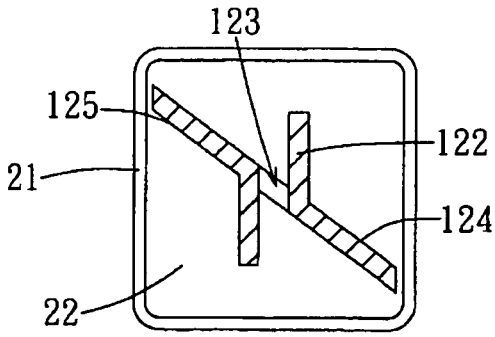

The cross-section of the distal end of each coupling section 12 may be changed to include a single L-shape (see FIG. 15), an L-shape and a T-shape (see FIG. 16), two T-shapes (see FIG. 17), or two V-shapes (see FIG. 18). Each supporting plate portion 121 is divided by the corresponding groove 123 into first and second plate half portions 124, 125. Each contacting plate portion 122 extends from the first or second plate half portion 124, 125.

Figure 20:
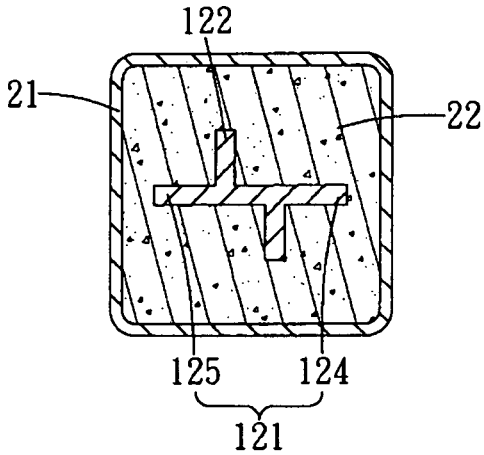
FIG. 20 is a sectional view taken along line 20-20 in FIG. 12.
Figure 21:
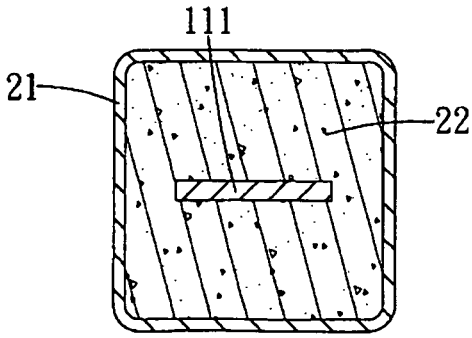
FIG. 21 is a sectional view taken along line 21-21 in FIG. 12.

To enable the restraining unit 2 to provide the radial restraining force effectively to the axial member 1, the portion of the axial member 1 surrounded by the surrounding member 21 is narrower than the remaining portion of the same disposed outwardly of the restraining unit 2. Thus, in design, the middle section 11 is narrower than the coupling sections 12. With further reference to FIGS. 20 and 21, and with particular reference to FIGS. 11 and 12, in this embodiment, each supporting plate portion 121 has an inner end portion that is connected to the middle section 11, that has a width along a second transverse direction (T2) perpendicular to the axial direction (A) and the first transverse direction (T1), and that reduces gradually in the width in a direction toward the middle section 11. Similarly, each contacting plate portion 122 has an inner end portion that is connected to the middle section 11, that has a width along the first transverse direction (T1), and that reduces gradually in the width in a direction toward the middle section 11. The inner end portions of the supporting plate portions 121 and the contacting plate portions 122 are surrounded by the surrounding member 21.

Figure 22:
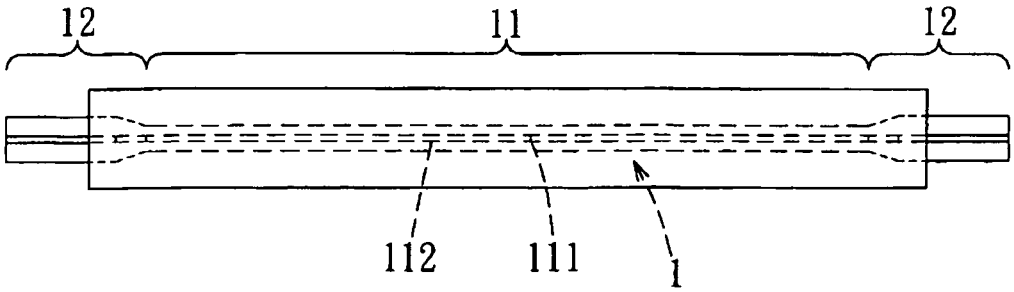
FIG. 22 is a view similar to FIG. 12 but illustrating a modified axial member formed with a reinforcing rib.
Figure 23:
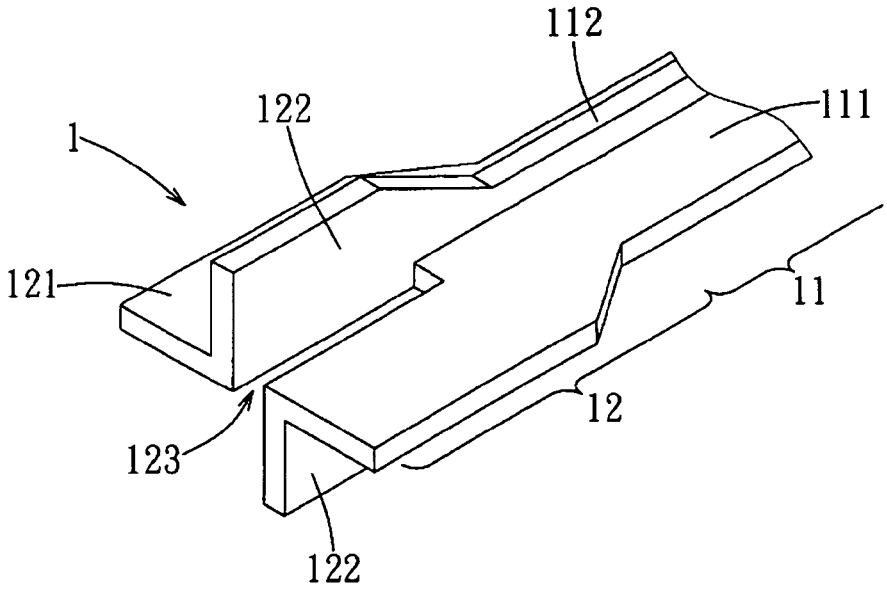
FIG. 23 is a view similar to FIG. 11 but illustrating the reinforcing rib of the modified axial member.

The axial member 1 is made of steel, which can be replaced with any other suitable metal or alloy. With further reference to FIGS. 22 and 23, to increase the structural strength of the axial member 1, a reinforcing rib 112 can be formed on a side surface of the elongated plate body 111. The reinforcing rib 112 extends along the axial direction (A), and has two opposite ends connected respectively and integrally to the contacting plate portion 122.

In this embodiment, the restraining member 22 is configured as a concrete material that fills a space between the surrounding member 21 and the axial member 1. In an alternative embodiment, the restraining member 22 includes a plurality of steel plates extending inwardly from the surrounding member 21 and in contact with the axial member 1.

Figure 24:
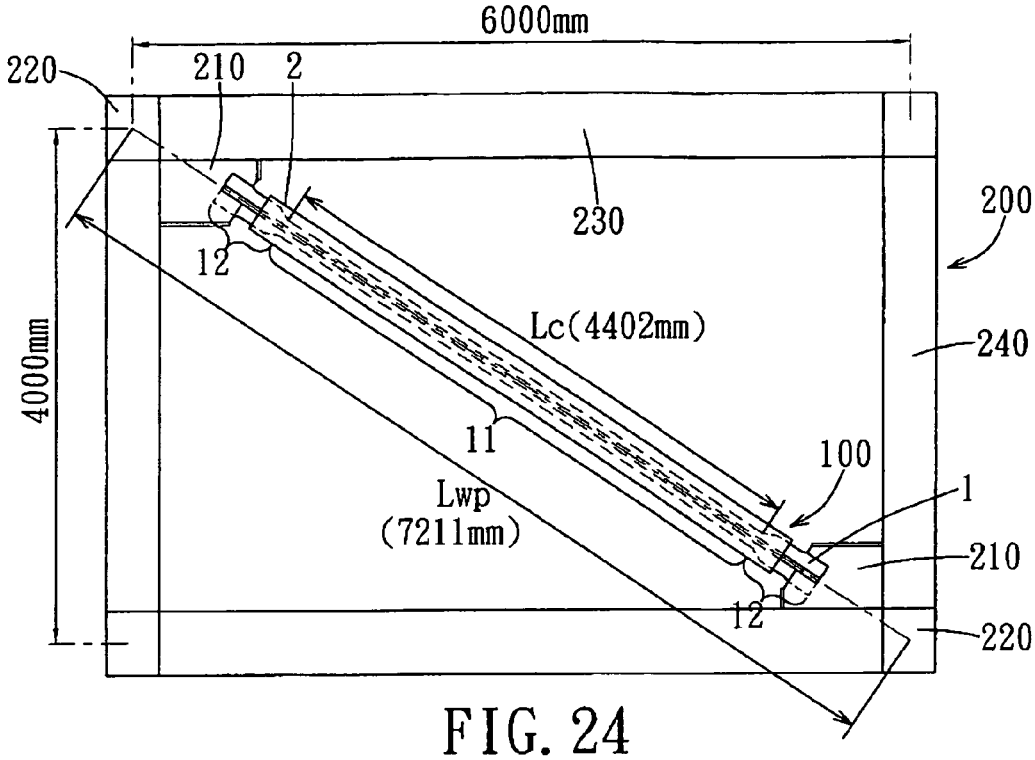
FIG. 24 is a schematic view of the first preferred embodiment and the framework of the building, illustrating a distance between the central points of two columns of the framework and the length of a middle section of the axial member.
Figure 25:
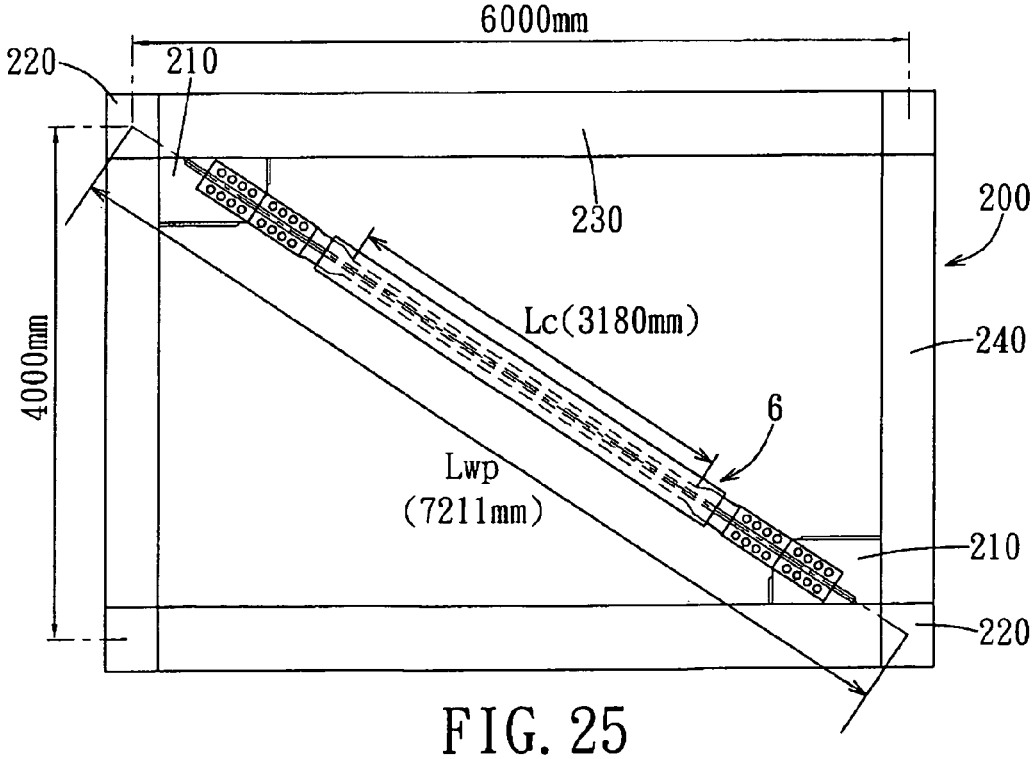
FIG. 25 is a view similar to FIG. 24 but illustrating the length of a middle section of the single-tube and single-core type conventional buckling restrained brace.

With further reference to FIG. 24, the building has four columns 220, two long beams 230, and two short beams 240. Each long beam 230 is supported by two of the columns 220, the central points of which are spaced apart from each other by a distance of 6000 mm. Each short beam 240 is supported by two of the columns 220, the central points of which are spaced apart from each other by a distance of 4000 mm. The energy-dissipating effect of the buckling restrained brace 100 is proportional to a ratio of the length (Lc) of the middle section 11 to a distance (Lwp) of 7211 mm between the central points of two of the columns 220 aligned with the buckling restrained brace 100, which is represented by a value ($\alpha$). In this embodiment, since the length (Lc) is 4402 mm, the value ($\alpha$) is about 0.61. However, if the buckling restrained brace 100 is replaced with the above-mentioned single-tube and single-core type conventional buckling restrained brace 6 (see FIG. 25), the length (Lc) of the middle section will be 3180 mm so that the value ($\alpha$) is only about 0.44. Thus, the service life of the buckling restrained brace 100 of this invention can be increased largely.

Figure 26:
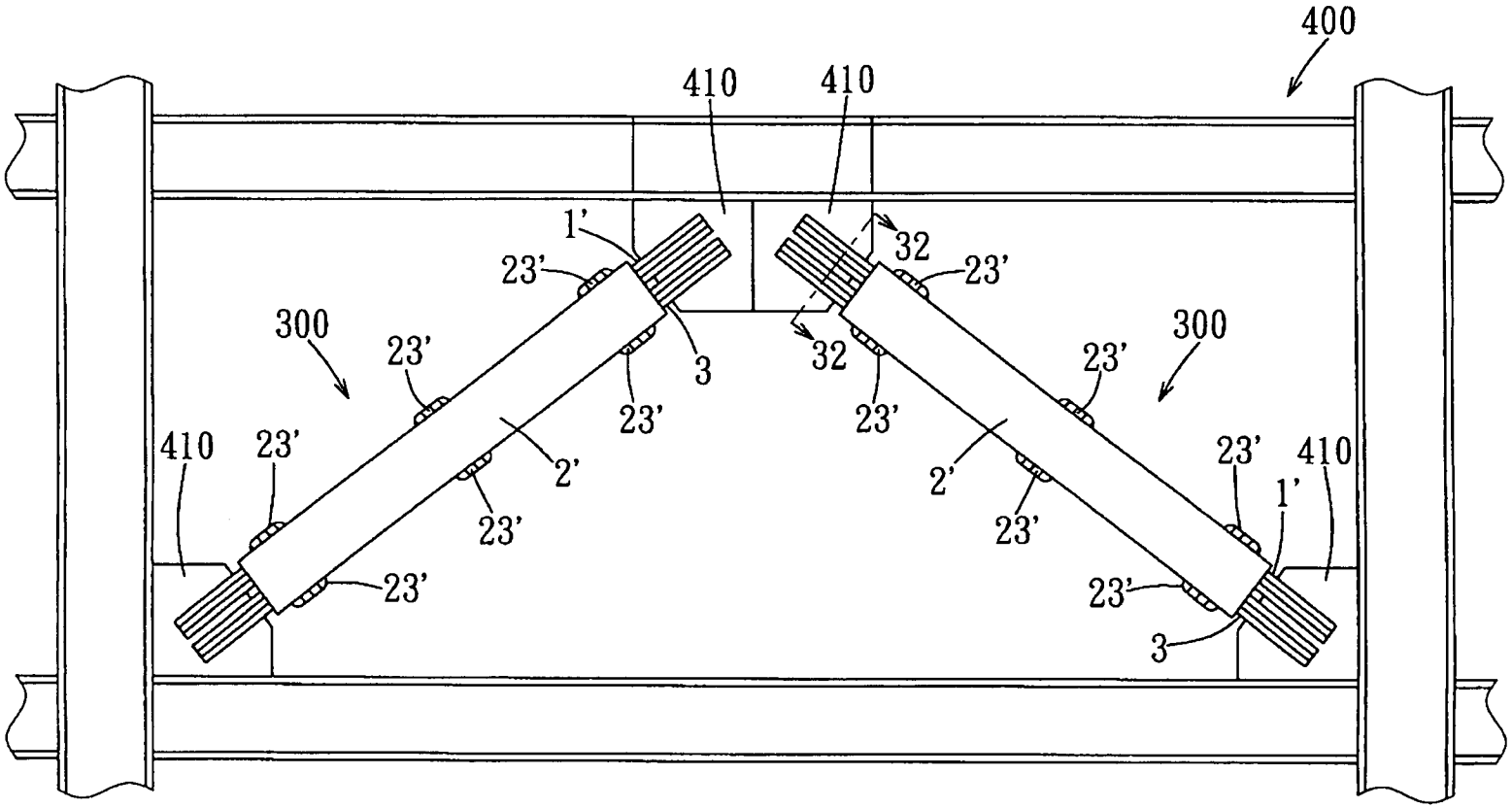
FIG. 26 is a schematic view of the second preferred embodiment of a buckling restrained brace according to this invention and a framework of a building.
Figure 27:
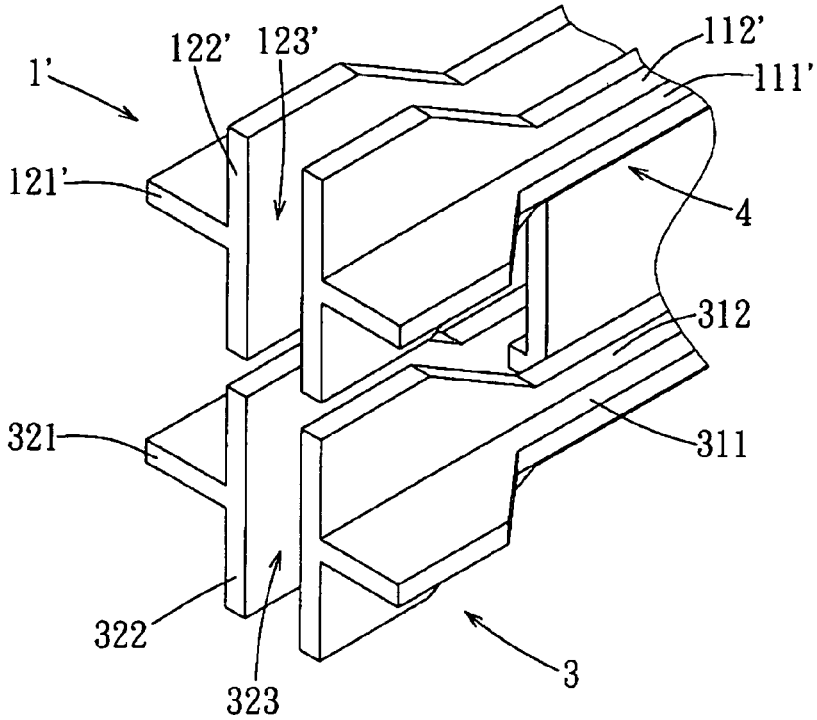
FIG. 27 is a fragmentary perspective view of the second preferred embodiment.
Figure 28:
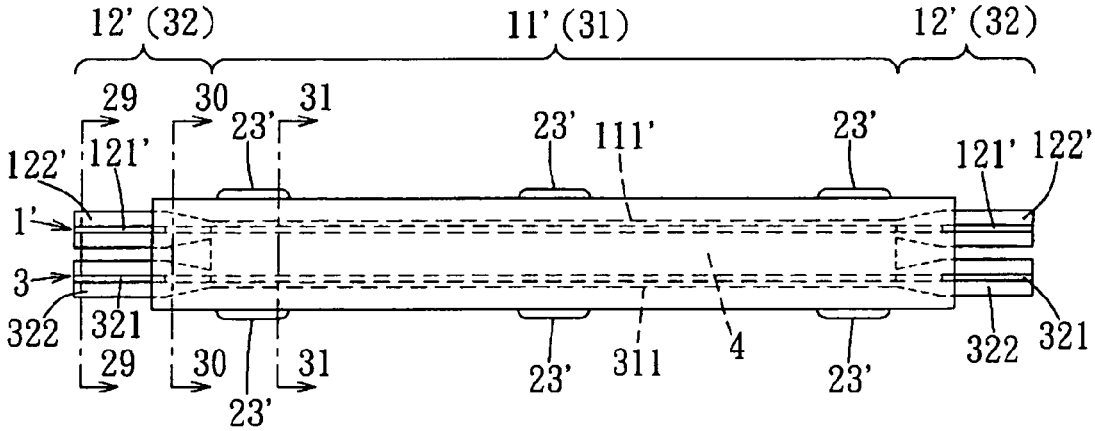
FIG. 28 is a schematic side view of the second preferred embodiment.

Referring to FIGS. 26, 27, and 28, the second preferred embodiment of a buckling restrained brace 300 according to this invention is connected fixedly to two connecting plates 410 of a steel framework 400. The buckling restrained brace 300 includes first, second, and third axial members 1', 3, 4 and a restraining unit 2'.

Figure 29:
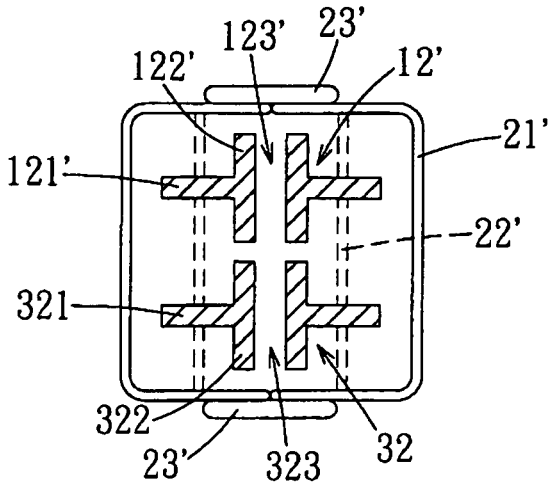
FIG. 29 is a sectional view taken along line 29-29 in FIG. 28.
Figure 30:
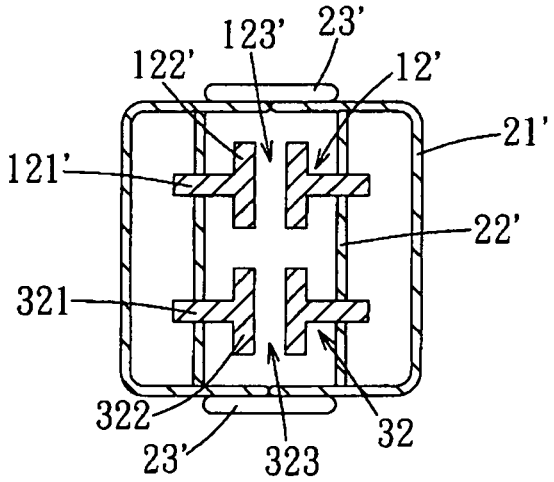
FIG. 30 is a sectional view taken along line 30-30 in FIG. 28.
Figure 31:
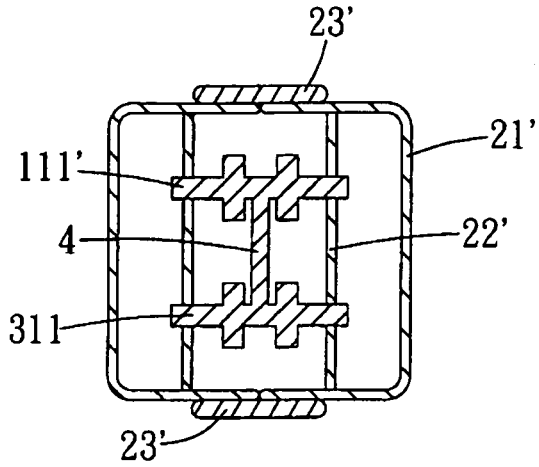
FIG. 31 is a sectional view taken along line 31-31 in FIG. 28.

With additional reference to FIGS. 29, 30, and 31, each of the first and second axial members 1', 3 is similar in construction to the axial member 1 (see FIGS. 11 and 12) of the first preferred embodiment. The first axial member 1' has a first middle section 11' and two first coupling sections 12'. The second axial member 3 has a second middle section 31 and two second coupling sections 32. Each of the first and second middle sections 11', 31 has an elongated plate body 111', 311. The third axial member 4 is disposed between and connected integrally and perpendicularly to the elongated plate bodies 111', 311 of the first and second middle sections 11', 31. Alternatively, the first and second axial members 1', 3 may be not parallel to each other. In addition, the third axial member 4 may be not perpendicular to the elongated plate bodies 111', 311 of the first and second middle sections 11', 31. Further, the number of the axial members 1', 3, 4 may be increased or reduced. In this embodiment, the first, second, and third axial members 1', 3, 4 are made of steel, which may be replaced with any other suitable mental or alloy.

The restraining unit 2' includes a surrounding member 21' disposed around the first, second, and third axial members 1', 3, 4, and a restraining member 22' disposed among the surrounding member 21' and the first, second, and third axial members 1', 3, 4 for providing a radial restraining force to the first, second, and third axial members 1', 3, 4.

Figure 32:
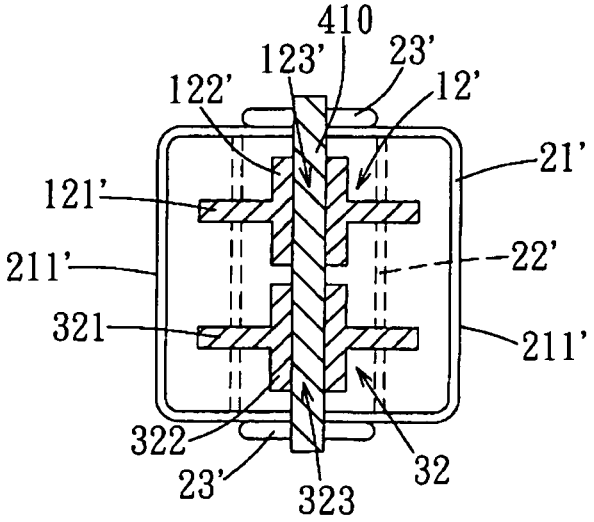
FIG. 32 is a sectional view taken along line 32-32 in FIG. 26.

Each first coupling section 12' has a first supplying plate portion 121' coplanar with the elongated plate body 111 of the first middle section 11', and a plurality of first contacting plate portions 122' extending from the first supplying plate portion 121'. Each first supporting plate portion 121' has an outer end surface formed with a first groove 123' that permits the corresponding connecting plate 410 to be inserted thereinto, as shown in FIG. 32.

Each second coupling section 32 has a second supplying plate portion 321 coplanar with the elongated plate body 311 of the second middle section 31, and a plurality of second contacting plate portions 322 extending from the second supplying plate portion 321. Each second supporting plate portion 321 has an outer end surface formed with a second groove 323 that permits the corresponding connecting plate 410 to be inserted thereinto, as shown in FIG. 32.

Figure 33:
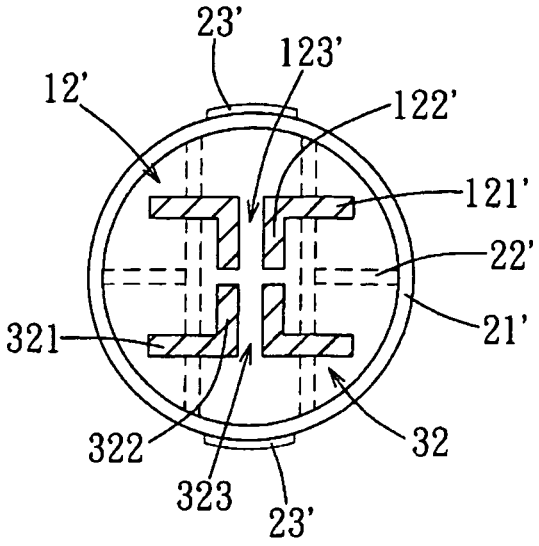
FIGS. 33 and 34 are views similar to FIG. 29 but illustrating modifications to the shapes of a rigid tube and coupling sections of first and second axial members of the second preferred embodiment.
Figure 34:
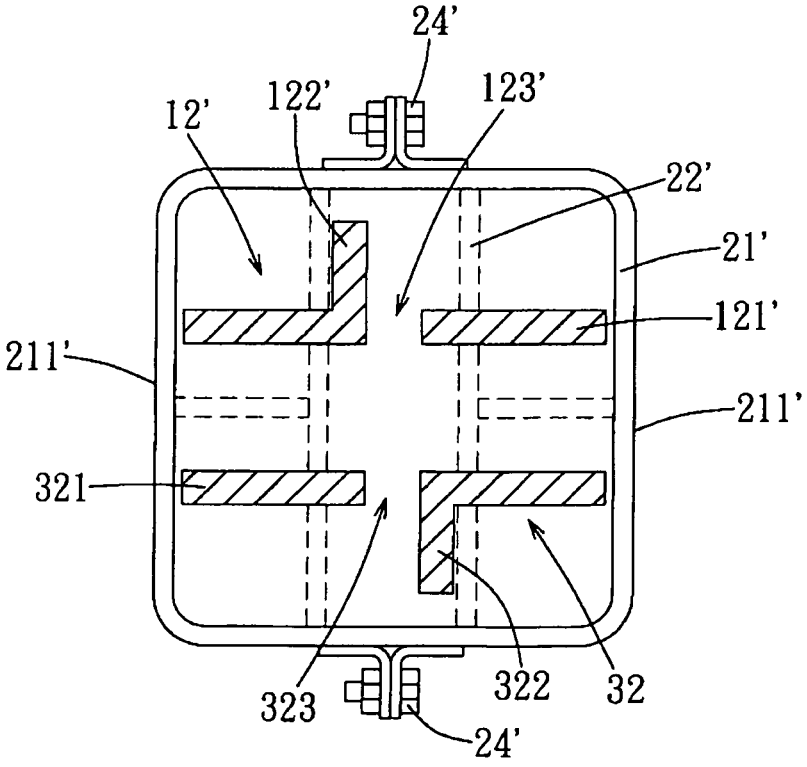

As such, the distal end of each of the first and second coupling sections 12', 32 has a cross-section that includes two T-shapes, as shown in FIG. 29. Alternatively, the shape of the cross-section of the distal end of each of the first and second coupling sections 12', 32 may be changed to those shown in FIGS. 33, 34.

With particular reference to FIG. 27, preferably, the first and second middle sections 11', 31 are formed with first and second reinforcing ribs 112', 312, respectively.

With particular reference to FIG. 32, in this embodiment, the surrounding member 21' is configured as a rigid tube that includes two tube halves 211' interconnected by welding a connecting sheet 23' thereto. Each tube half 211' has a U-shaped cross-section. In an alternative arrangement, the tube halves 211' may be interconnected removably by bolts 24' (see FIG. 34).

In this embodiment, the restraining member 22' includes a plurality of steel plates each extending inwardly from the surrounding member 21' and in contact with at least one of the first, second, and third axial members 1', 3, 4. Preferably, the steel plates constituting the restraining member 22' are arranged in a symmetrical manner. Alternatively, the restraining member 22' may be configured as a concrete material that fills spaces among the surrounding member 21' and the first, second, and third axial members 1', 3, 4.

With this invention thus explained, it is apparent that numerous modifications and variations can be made without departing from the scope and spirit of this invention. It is therefore intended that this invention be limited only as indicated by the appended claims.

We claim:

1. A buckling restrained brace adapted to be connected fixedly between two connecting plates of a framework of a building, said buckling restrained brace comprising:

a first axial member extending along an axial direction and having a first middle section and two first coupling sections extending respectively and integrally from two opposite ends of said first middle section, said first middle section having an elongated plate body, each of said first coupling sections having a first supporting plate portion that is coplanar with the elongated plate body of the first middle section and that has an outer end portion formed with a first groove extending along the axial direction, and two first contacting plate portions extending respectively and perpendicularly from two walls of said first supporting plate portion defining respectively two opposite sides of said first groove in opposite directions, so that a distal end of each of said first coupling sections has a cross-section that includes two L-shapes, each of said first coupling sections being made in one piece, said first groove being adapted to permit a respective one of the connecting plates to engage fittingly therewith, said first contacting plate portions of each of said first coupling sections being adapted to be in contact with, connected fixedly to, and parallel to a corresponding one of the connecting plates; and a restraining unit including a surrounding member disposed around said first axial member, and a restraining member disposed between said first axial member and said surrounding member so as to provide a radial restraining force to said first axial member.

2. The buckling restrained brace as claimed in claim 1, wherein each of said first contacting plate portions of each of said first coupling sections has an inner end portion that is connected to said first middle section, that has a width along the first transverse direction, and that reduces gradually in the width in a direction toward said first middle section.

3. The buckling restrained brace as claimed in claim 2, wherein said inner end portions of said first contacting plate portions of said first coupling sections and said first middle section are surrounded by said surrounding member.

4. The buckling restrained brace as claimed in claim 1, wherein said first middle section further has a first reinforcing rib that is formed on a side surface of said elongated plate body, that extends along the axial direction, and that has two opposite ends each connected integrally to a corresponding one of said first contacting plate portions of said first coupling sections.

5. The buckling restrained brace as claimed in claim 1, wherein said first supporting plate portion of each of said first coupling sections has an inner end portion that is connected to said first middle section, that has a width along a second transverse direction perpendicular to the axial direction and the first transverse direction, and that reduces gradually in the width in a direction toward said first middle section.

6. The buckling restrained brace as claimed in claim 5, wherein said inner end portions of said first supporting plate portions of said first coupling sections and said first middle section are surrounded by said surrounding member.

7. The buckling restrained brace as claimed in claim 1, wherein said surrounding member is configured as a rigid tube.

8. The buckling restrained brace as claimed in claim 7, wherein said rigid tube includes two tube halves that are interconnected removably, each of said tube halves having a U-shaped cross-section.

9. The buckling restrained brace as claimed in claim 7, wherein said restraining member is configured as a concrete material that fills a space between said rigid tube and said first axial member.

10. The buckling restrained brace as claimed in claim 7, wherein said restraining member includes a plurality of steel plates extending inwardly from said rigid tube and in contact with said first axial member.

11. The buckling restrained brace as claimed in claim 1, further comprising a second axial member extending along the axial direction and including a second middle section and two second coupling sections extending respectively and integrally from two opposite ends of said second middle section, said second middle section having an elongated plate body, each of said second coupling sections having a second supporting plate portion coplanar with the elongated plate body of the second middle section, and a second contacting plate portion extending from said second supporting plate portion in the first transverse direction, said second supporting plate portion of each of said second coupling sections having an outer end formed with a second groove that extends along the axial direction, that is formed through said second supporting plate portion along the first transverse direction, and that is adapted to permit a respective one of the connecting plates to engage fittingly therewith, said second contacting plate portion of each of said second coupling sections being adapted to be in contact with and parallel to a corresponding one of the connecting plates.

12. The buckling restrained brace as claimed in claim 11, further comprising a third axial member interconnecting fixedly said elongated plate bodies of said first and second middle sections.

13. The buckling restrained brace as claimed in claim 12, wherein said surrounding member is configured as a rigid tube, and said restraining member is configured as a concrete material that fills spaces among said rigid tube and said first, second and third axial members.

14. The buckling restrained brace as claimed in claim 12, wherein said surrounding member is configured as a rigid tube, and said restraining member includes a plurality of steel plates each extending inwardly from said rigid tube and in contact with at least one of said first, second and third axial members.

15. A buckling restrained brace assembly comprising:

a connecting plate;

a first axial member extending along an axial direction and having a first middle section and a first coupling section extending integrally from an end of said first middle section, said first middle section having an elongated plate body, said first coupling section having a first supporting plate portion that is coplanar with the elongated plate body of the first middle section and that has an outer end formed with a first groove extending along the axial direction, and two first contacting plate portions extending respectively and perpendicularly from two walls of said first supporting plate portion defining respectively two opposite sides of said first groove in opposite directions, so that a distal end of each of said first coupling sections has a cross-section that includes two L-shapes, said first coupling section being made in one piece, said first groove being adapted to permit the connecting plate to engage fittingly therewith, said first contacting plate portions being adapted to be in contact with, connected fixedly to, and parallel to the connecting plate; and a restraining unit including a surrounding member disposed around said first axial member, and a restraining member disposed between said first axial member and said surrounding member so as to provide a radial restraining force to said first axial member.

16. The buckling restrained brace assembly as claimed in claim 15, wherein each of said first contacting plate portions of said first coupling section has an inner end portion that is connected to said first middle section, that has a width along the first transverse direction, and that reduces gradually in the width in a direction toward said first middle section.

17. The buckling restrained brace assembly as claimed in claim 16, wherein said inner end portions of said first contacting plate portions and said first middle section are surrounded by said surrounding member.

18. The buckling restrained brace assembly as claimed in claim 15, wherein said first middle section further has a first reinforcing rib that is formed on a side surface of said elongated plate body, that extends along the axial direction, and that has an end connected integrally to one of said first contacting plate portions.

19. The buckling restrained brace assembly as claimed in claim 15, wherein said first supporting plate portion has an inner end portion that is connected to said first middle section, that has a width along a second transverse direction perpendicular to the axial direction and the first transverse direction, and that reduces gradually in the width in a direction toward said first middle section.

20. The buckling restrained brace assembly as claimed in claim 19, wherein said inner end portion of said first supporting plate portion and said first middle section are surrounded by said surrounding member.

21. The buckling restrained brace assembly as claimed in claim 15, wherein said first supporting plate portion is adapted to be perpendicular to the connecting plate.

22. The buckling restrained brace assembly as claimed in claim 15, wherein said first supporting plate portion is divided by said first groove into two plate half portions, from which said two first contacting plate portions extend respectively.

23. The buckling restrained brace assembly as claimed in claim 15, wherein said surrounding member is configured as a rigid tube.

24. The buckling restrained brace assembly as claimed in claim 23, wherein said rigid tube includes two tube halves that are interconnected removably, each of said tube halves having a U-shaped cross-section.

25. The buckling restrained brace assembly as claimed in claim 23, wherein said restraining member is configured as a concrete material that fills a space between said rigid tube and said first axial member.

26. The buckling restrained brace assembly as claimed in claim 23, wherein said restraining member includes a plurality of steel plates extending inwardly from said rigid tube and in contact with said first axial member.

27. The buckling restrained brace assembly as claimed in claim 15, further comprising a second axial member extending along the axial direction and including a second middle section and a coupling section extending integrally from an end of said second middle section, said second middle section having an elongated plate body, said second coupling section having a second supporting plate portion coplanar with the elongated plate body of the second middle section, and a second contacting plate portion extending from said second supporting plate portion in the first transverse direction, said second supporting plate portion having an outer end formed with a second groove that extends along the axial direction, that is formed through said second supporting plate portion along the first transverse direction, and that is adapted to permit the connecting plate to engage fittingly therewith, said second contacting plate portion being adapted to be in contact with and parallel to the connecting plate.

28. The buckling restrained brace assembly as claimed in claim 27, further comprising a third axial member interconnecting fixedly said elongated plate bodies of said first and second middle sections.

29. The buckling restrained brace assembly as claimed in claim 28, wherein said surrounding member is configured as a rigid tube, and said restraining member is configured as a concrete material that fills spaces among said rigid tube and said first, second and third axial members.

30. The buckling restrained brace assembly as claimed in claim 28, wherein said surrounding member is configured as a rigid tube, and said restraining member includes a plurality of steel plates each extending inwardly from said rigid tube and in contact with at least one of said first, second and third axial members.

* * * * *